US007461823B2

(12) United States Patent
Decker et al.

(10) Patent No.: US 7,461,823 B2
(45) Date of Patent: Dec. 9, 2008

(54) APPARATUS AND METHOD FOR RETAINING A RECREATIONAL VEHICLE ATTACHMENT

(75) Inventors: Daniel Decker, Castle Rock, CO (US); Eric Becker, Sedalia, CO (US); John Kromka, Castle Rock, CO (US); Josh Middel, Littleton, CO (US)

(73) Assignee: B & D Manufacturing, Inc., Sedalia, CO (US)

( * ) Notice: Subject to any disclaimer, the term of this patent is extended or adjusted under 35 U.S.C. 154(b) by 78 days.

(21) Appl. No.: 11/556,955

(22) Filed: Nov. 6, 2006

(65) Prior Publication Data

US 2008/0105806 A1 May 8, 2008

(51) Int. Cl.
*E06B 9/17* (2006.01)

(52) U.S. Cl. ..... 248/273; 248/230.8

(58) Field of Classification Search ..... 248/273, 248/269, 345, 230.1, 230.2, 230.9; 160/67; 135/120.3, 88.1, 903, 904, 88.07, 88.09, 135/298, 299; 24/298, 299; 296/141, 163; 403/62, 70

See application file for complete search history.

(56) References Cited

U.S. PATENT DOCUMENTS 3,825,023 A 7/1974 Bergeron
5,346,165 A 9/1994 Frean et al.
5,423,506 A 6/1995 Spoon
5,819,830 A 10/1998 Verelst
5,913,564 A * 6/1999 Stewart et al. ..... 296/172
6,254,051 B1 7/2001 Hubbard et al.
6,557,814 B1 5/2003 Rutz
6,871,685 B2 3/2005 Freney
7,008,000 B1 3/2006 Schmeichel
7,048,277 B1 5/2006 Schmeichel
2003/0217442 A1* 11/2003 Peterson et al. ..... 24/298
2005/0039309 A1* 2/2005 McCauley et al. ..... 24/299
2006/0150375 A1* 7/2006 Moore ..... 24/299

* cited by examiner

*Primary Examiner*—Ramon O Ramirez
(74) *Attorney, Agent, or Firm*—Sheridan Ross P.C.

(57) ABSTRACT

An apparatus and method are disclosed for retaining an attachment, such as an awning, to the wall of a recreational vehicle. The apparatus includes a flexible strap assembled from a plurality of strap segments. Male and female portions of adjacent strap segments are joined together to form a flexible interconnection between adjacent strap segments. The apparatus also includes an upper mounting portion for fixedly connecting a first end of the strap to the wall, and a lower mounting portion for detachably connecting a second end of the strap to the wall. Also disclosed are methods of installing and using an apparatus for retaining a recreational vehicle attachment.

19 Claims, 4 Drawing Sheets

APPARATUS AND METHOD FOR RETAINING A RECREATIONAL VEHICLE ATTACHMENT

FIELD OF THE INVENTION

Retaining devices for use with recreational vehicle awnings or other attachments.

BACKGROUND OF THE INVENTION

Recreational vehicles may include awnings or other attachments that are used when the vehicle is not moving. The awning or other device may be mounted to the exterior wall of the recreational vehicle. When in use, the awning extends outwardly from the wall of the vehicle to provide a shaded area. When the recreational vehicle is in motion, the awing is rolled up and secured to the wall of the vehicle.

Prior art devices used to retain an awning against the exterior wall of a recreational vehicle include a leather or fabric strap and buckle for tightening the strap. Such devices suffer from several limitations, including the tendency for the buckle to corrode or rust. The strap may also weaken or fray over time. A strap and buckle system may also be inadequate for securing heavier awnings, as they may bounce around or otherwise shift under the influence of their greater weight. Additionally, it may be inconvenient or burdensome for a person to position the strap and thread the buckle, especially when simultaneously supporting the weight of the awning.

U.S. Pat. No. 3,825,023 to Bergerson discloses a C-shaped trailer awning strap for retaining an awning to the side of recreational vehicle. While this device is simpler to use than the conventional buckle and strap system, it lacks a secure attachment for the strap underneath the awning. In particular, the Bergerson strap contains a folded end portion that is tucked underneath the awning and held in place by the weight of the strap. This device may be prone to failure, especially when traveling on bumping roads that cause the weight of the awning to shift.

Accordingly, it would desirable to have an apparatus for easily and reliably retaining an awning or other attachment to the side of recreational vehicle. Such an apparatus would be capable of securing heavier awnings and would prevent the awning from moving around excessively when the vehicle is in motion.

SUMMARY OF THE INVENTION

The present invention is directed to an apparatus and method for retaining an attachment, such as an awning, to the exterior wall of a recreation vehicle. The apparatus includes a flexible strap that is fixedly connectable at one end to the wall of the recreational vehicle. The other end of the flexible strap is detachably connectable to the wall of the recreational vehicle. The strap is connectable to the wall of the recreational vehicle via upper and lower mounting portions disposed above and below the awning. Preferably a detachable connection is provided by the lower mounting portion disposed below the awning.

The flexible strap includes a plurality of interconnected strap segments that allow the strap to bend. Each strap segment contains a male end portion and a female end portion. The strap segments are interconnected by mating a male end portion of one segment with a female end portion of another strap segment. The interconnection is then secured by means of a bolt or other appropriate fastener. The mounting portion may also include male and female end portions that may be used to interconnect with the flexible strap.

Embodiments of the present invention are directed to a method for installing an apparatus for retaining an attachment to a recreational vehicle. The method involves first installing an upper and lower mounting portion on a wall of the recreational vehicle. Next, an estimation is made of the length of strap needed to fit around a portion of the recreational vehicle attachment when the attachment is rolled up and paced between the mounting portions. Then a flexible strap of the estimated length is assembled from a plurality of strap segments. The strap's fit is then tested, and strap segments are either added or removed to provide a more accurate fit. Additionally, a shoulder bolt or other suitable fastener used in connection with the lower mounting portion may be placed in one of several possible placement locations to further ensure a secure fit for the flexible strap.

Embodiments of the present invention are also directed to a method for using an apparatus for retaining an attachment to a recreational vehicle. The method involves first rolling up the recreational attachment. The attachment is then placed against a wall of the recreational vehicle between an upper and a lower mounting portion. Finally, a strap, having a fixed connection to the upper mounting portion, is clamped to the lower mounting portion. Thus, the recreational vehicle attachment is secured against the wall of the recreational vehicle.

DETAILED DESCRIPTION

The present invention comprises an apparatus for restraining an attachment to the exterior wall of a recreational vehicle. The apparatus includes a flexible strap composed of a series of interconnected segments. Both ends of the flexible strap are designed to be mounted on the exterior wall of a recreational vehicle. One end of the strap is designed to detach from its mounting, allowing the recreational vehicle attachment to be placed between the strap and the external wall. With the attachment placed there between, the detachable end of the strap is reattached to its mounting, thus securing the attachment to the exterior wall of the recreational vehicle.

All awning is an example of a recreational attachment that may be secured by the present invention. Awnings can be mounted to the exterior wall of a recreational vehicle. When the vehicle is in motion, the awning is rolled up or otherwise contracted for storage against the exterior wall of the vehicle. When the vehicle is parked, the awning may be unrolled or otherwise extended. Typically, an awning wand is supplied with the vehicle which can be used to facilitate unwinding and extension of the awning. In an unrolled or extended state the awning provides a shaded area adjacent to the vehicle. Alternatively, the present invention may be used to secure a tent, collapsible room or other device to the exterior wall of the vehicle. Generally, the present invention may be used to secure any kind of bulky equipment to the exterior wall of a recreational vehicle.

Figure 1:
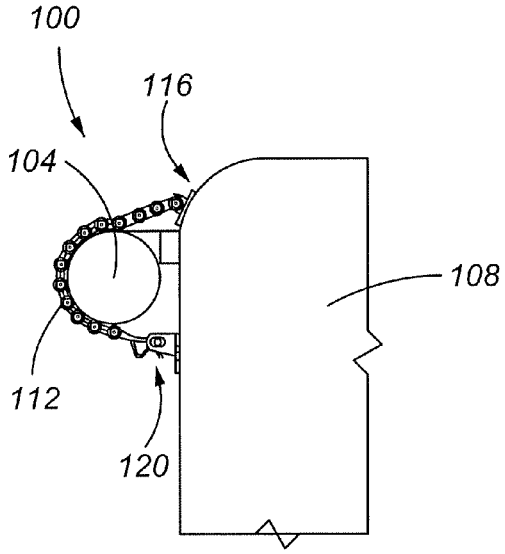
FIG. 1 is a side view of an apparatus in accordance with embodiments of the present invention.

Referring now to FIG. 1, a side view of an apparatus in accordance with embodiments of the present invention is generally identified by reference numeral 100. The apparatus 100 is shown in use, restraining a recreational vehicle attachment 104 to an exterior wall of a recreational vehicle 108. The apparatus 100 includes a flexible strap 112 that extends around a portion of the recreational vehicle attachment 104. The flexible strap 112 is connected to the exterior wall of the recreational vehicle 108 by means of mounting portions 116 and 120. As can be seen from FIG. 1, the recreational vehicle attachment 104 is secured to the exterior wall of the recreational vehicle 108 by being rolled up and placed between the mounting portions 116 and 120 in a space between the flexible strap 112 and the exterior wall of the recreational vehicle 108.

In accordance with embodiments of the present invention, access to the space between the flexible strap 112 and the exterior wall of the recreational vehicle 108 is achieved by providing the apparatus 100 with at least one detachable attachment. In particular, the lower mounting portion 120, generally and preferably disposed beneath the recreation vehicle attachment 104, is adapted to detachably receive an end of the flexible strap 112. In contrast, the upper mounting portion 116, generally and preferably disposed above the recreational vehicle attachment 104, is adapted to fixedly attach an end of the flexible strap 112 to the exterior wall of the recreational vehicle 108. Accordingly, the flexible strap 112 may be detached from the exterior wall of the recreational vehicle 108 at the lower mounting portion 120, allowing the recreational vehicle attachment 104 to be unrolled or otherwise outwardly extended. At a later time, when the attachment 104 needs to be again secured against the exterior wall of the recreational vehicle 108, the attachment 104 may rolled up or otherwise contracted and placed between the mounting portions 116 and 120. The attachment 104 is then secured in place by attaching the flexible strap 112 to the exterior wall of the recreational vehicle 108 at the lower mounting portion 120. It should also be understood by those of skill in the art that, depending upon application, it may be desirable to have the lower mounting portion 120 be fixed and the upper mounting portion not be fixed to facilitate attachment of the flexible strap 112.

Figure 2:
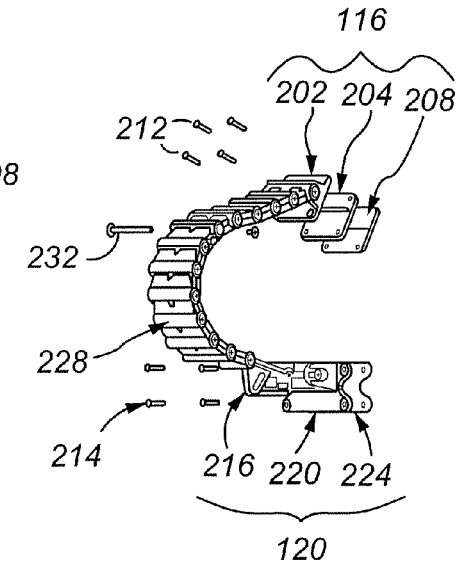
FIG. 2 is an exploded perspective view of the apparatus shown in FIG. 1.

FIG. 2, an exploded perspective view, illustrates the construction of an apparatus 100 in accordance with embodiments of the present invention. The upper mounting portion 116 may be comprised of plurality of discrete parts. In accordance with at least one embodiment of the present invention, the upper mounting portion 116 contains an upper mounting bracket 202, a radii plate 204, and an upper gasket 208. The upper mounting bracket 202 preferably provides a fixed, non-detachable attachment to an upper end of the flexible strap 112. The radii plate 204 and the upper gasket 208 are placed between the upper mounting bracket 202 and the exterior wall of the recreational vehicle 108. The upper mounting portion 116 is attached to the exterior wall of the recreational vehicle 108 by means of screws 212. Those skilled in the art would understand that any number of configurations could be utilized to create an upper mounting portion 116 for use with flexible strap 112.

Still referring to FIG. 2, the construction of the preferred lower mounting portion 120 is illustrated. The lower mounting portion 120 may also be comprised of a plurality of discrete parts. In accordance with at least one embodiment of the present invention, the lower mounting portion 120 includes a lower attachment member 216, a lower mounting bracket 220, and a lower gasket 224. The lower attachment member is disposed on the lower end of the flexible strap 112 and is adapted to be detachably received by the lower mounting bracket 220. The lower gasket 224 is placed between the lower mounting bracket 220 and the exterior wall of the recreational vehicle 108. The lower gasket 224 and the lower mounting bracket 220 are secured to the exterior wall of the recreational vehicle by means of screws 214. Again, those skilled in the art would understand that lower mounting portion 120 could be constructed of virtually any mechanism which would have the functionality of providing an anchor for the flexible strap 112.

As can be seen in FIG. 2, the flexible strap is comprised of a series of strap segments 228. Adjacent strap segments 228 are interconnected by means of a bolt 232. This interconnection provides a degree of rotational freedom between adjacent segments 228 that allows the flexible strap 112 to bend. This bending allows the flexible strap 112 to fit around a portion of the recreational vehicle attachment 104 when the attachment is rolled-up for securement against the exterior wall of the vehicle 108. Those of skill in the art would understand that the mechanism utilized to secure together the adjacent strap segments 228 could be any fastening device that would allow for a degree of rotational freedom between adjacent segments 228, such as cotter pins, rivets, etc.

Figure 3A:
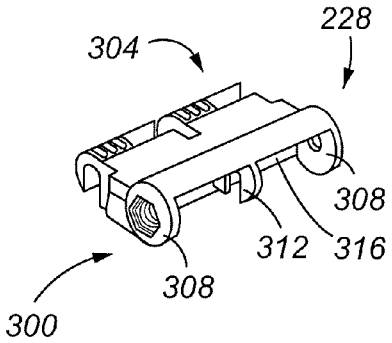
FIG. 3A is a top perspective view of a strap segment in accordance with embodiments of the present invention.
Figure 3B:
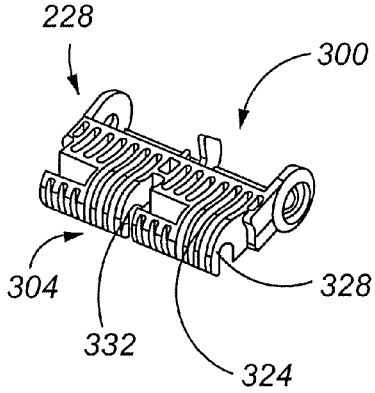
FIG. 3B is a bottom perspective view of the strap segment shown in FIG. 3A.

FIG. 3A and FIG. 3B show detailed perspective views of a strap segment 228 in accordance with preferred embodiments of the present invention. FIG. 3A shows a strap segment 228 in an upright orientation. FIG. 3B shows a strap segment 228 in an upside down orientation. Each strap segment 228 includes a female end portion 300 and a male end portion 304. The end portions 300 and 304 allow the strap segments 228 to be interconnected. In particular, the female end 300 of one strap segment 228 is mated with the male end 304 of an adjacent strap segment 228. As described above, the attachment is held in place by means of a bolt 232. The flexible strap 112 is oriented such that the upper end contains a male portion 304 that is not mated to a strap segment 228 and the lower end contains a female portion 300 that is not mated to a strap segment 228.

Still referring to FIG. 3A and FIG. 3B, the female end 300 of a strap segment 228 includes two holes 308 disposed on either side of the strap segment 228 for receiving a fastener, such as bolt 232. Additionally, a support member 312 is disposed between the holes 308. The female portion 300 also includes a rounded inner surface 316 adapted to receive a rounded portion 324 of the male end 304 of an adjacent strap segment 228. A male end 304 of a strap segment 228 additionally includes a longitudinal passageway 328 extending between the side, of the strap segment 228 for receiving a fastener, such as bolt 232. A male end 304 of a strap segment 228 also includes a slot 332 for receiving the support member 312 of an adjacent female end 300 of a strap segment 228. An attachment between adjacent strap segments 228 is achieved by first mating the female end 300 of one strap segment 228 to the male end 304 of another strap segment 228. Then a fastener, such as a bolt 232, is placed through one hole 308 of the first strap segment 228, through the longitudinal passageway 328 of the second strap segment 228, through the second hole 232 of the first strap segment 228, and then appropriately secured. The flexible strap 112 is comprised of plurality of strap segments 228 interconnected in a similar manner. As would be understood by one skilled in the art, the strap segments can be made of virtually any resilient material, including various plastics, metals, carbon fiber, etc.

Figure 4A:
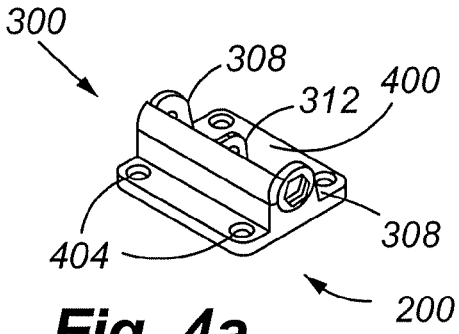
FIG. 4A is a top perspective view of an upper mounting bracket in accordance with embodiments of the present invention.
Figure 4B:
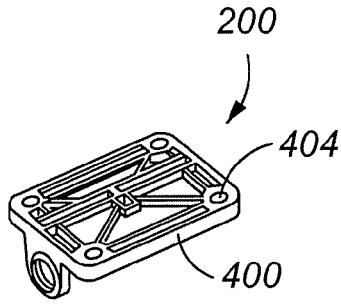
FIG. 4B is a bottom perspective view of the upper mounting bracket shown in FIG. 4A.

FIG. 4A and FIG. 4B show detailed perspective views of a preferred upper mounting bracket 202 in accordance with embodiments of the present invention. FIG. 4A shows an upper mounting bracket 202 in an upright orientation. FIG. 4B shows an upper mounting bracket 202 in an upside down orientation. The mounting bracket 202 includes a plate portion 400 containing holes 404 adapted to receive screws 212. Additiomdly, the mounting bracket 202 includes a female portion end portion 300. As mentioned above, the upper end of the flexible strap 112 contains an unmated male end portion 304. Accordingly, flexible strap 112 is attached to the exterior wall of the recreation vehicle 108 by means of a connection between a female portion end portion 300 of the upper mounting bracket 400 and a male end portion 304 of a strap segment 228. Like the interconnections between adjacent strap segments 228, the interconnection between a strap segment 228 and the upper mounting bracket 400 allows a degree of rotational freedom between the segment 228 and the bracket 400.

Figure 5A:
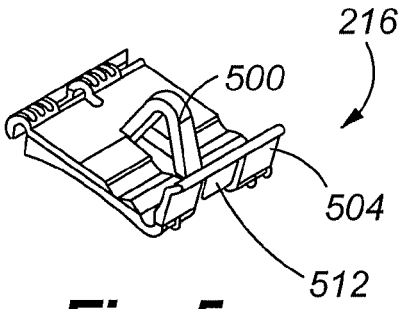
FIG. 5A is a top perspective view of a lower attachment member in accordance with embodiments of the present invention.
Figure 5B:
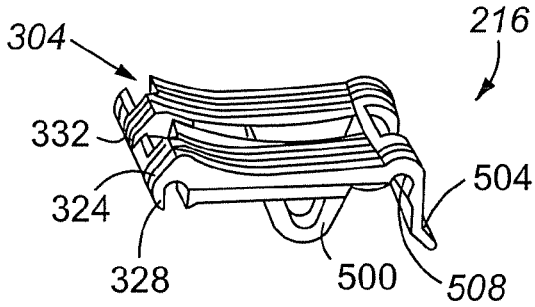
FIG. 5B is a bottom perspective view of the lower attachment member shown in FIG. 5A.

FIG. 5A and FIG. 5B show detailed perspective views of a preferred lower attachment member 216 in accordance with one embodiment. FIG. 5A shows a lower attachment member 216 in an upright orientation. FIG. 5B shows a lower attachment member 216 in an upside down orientation. The lower attachment 216 includes a male end portion 304. As mentioned above, the lower end of the flexible strap 112 contains an unmated female end portion 300. Accordingly, the flexible strap 112 and the lower attachment member 216 are interconnected by means of a mating between their respective female 300 and male 304 end portions. Additionally, the lower attachment member 216 includes a guide member 500 and a clamp portion 504. The clamp portion 504 is adapted to fit around a shoulder bolt mounted on the lower mounting bracket 220, such that the bolt fits inside the recessed portion 508 of the clamp 504. The clamp 504 further includes a tab 512 that fits over the bolt to hold the clamp 504 in place. A pole, adapted to receive at least a portion of the lower attachment member 216, may be used to guide the clamp portion 504 into place for attachment with the lower mounting bracket 220. Preferably, the pole is the awning wand that is often supplied with the vehicle.

Figure 6A:
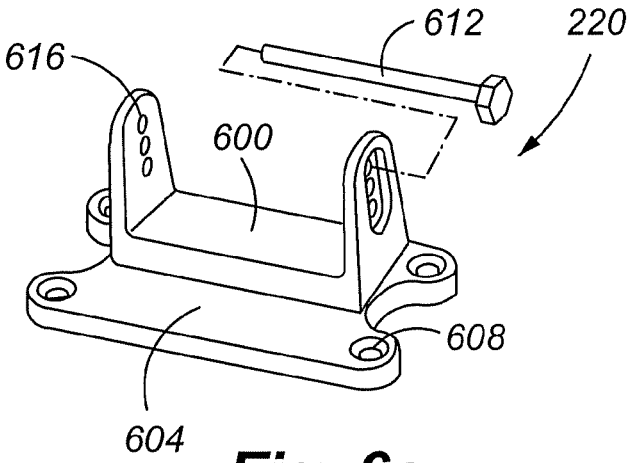
FIG. 6A is a top perspective view of a lower mounting bracket in accordance with embodiments of the present invention.
Figure 6B:
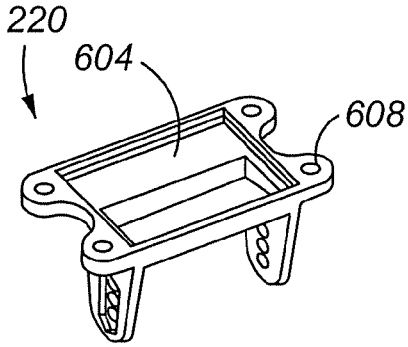
FIG. 6B is a bottom perspective view of the lower mounting bracket shown in FIG. 6A.

FIG. 6A and FIG. 6B show detailed perspective views of a preferred lower mounting bracket 220 in accordance with embodiment of the present invention. FIG. 6A shows a lower mounting bracket 220 in an upright orientation. FIG. 6B shows a lower mounting bracket 220 in an upside down orientation. The lower mounting bracket 220 includes a shoulder bolt mount 600 attached to a plate member 604. The plate member 604 includes holes 608 adapted to receive screws 214. The shoulder bolt mount 600 includes a plurality of shoulder bolt hole pairs 616 each adapted to receive a shoulder bolt 612. Depending on the size of the recreational vehicle attachment 104, the shoulder bolt 612 may be mounted in the hole pair 616 that provides the most secure fit for the apparatus 100 to the recreation vehicle attachment 104. The shoulder bolt 612 is operatively associated with the clamp 504 as described above to provide a detachable attachment between the flexible strap 112 and the lower mounting portion 120.

As can be appreciated, the various recreational vehicle attachments 104 that may be secured to a recreational vehicle 108 can be of different sizes. Accordingly, the installation of a particular apparatus 100 in accordance with embodiments of the present invention involves sizing the strap 112 to a length that provides a secure fit for the particular attachment 104 that is to be secured. Sizing the strap 112 involves first building a strap 112 from a plurality of strap segments 228. Strap segments 112 are either added or removed until length is found that provides a secure fit. Finer grain adjustments to the fit can be achieved by adjusting the shoulder bolt 612 placement as described above.

Figure 7:
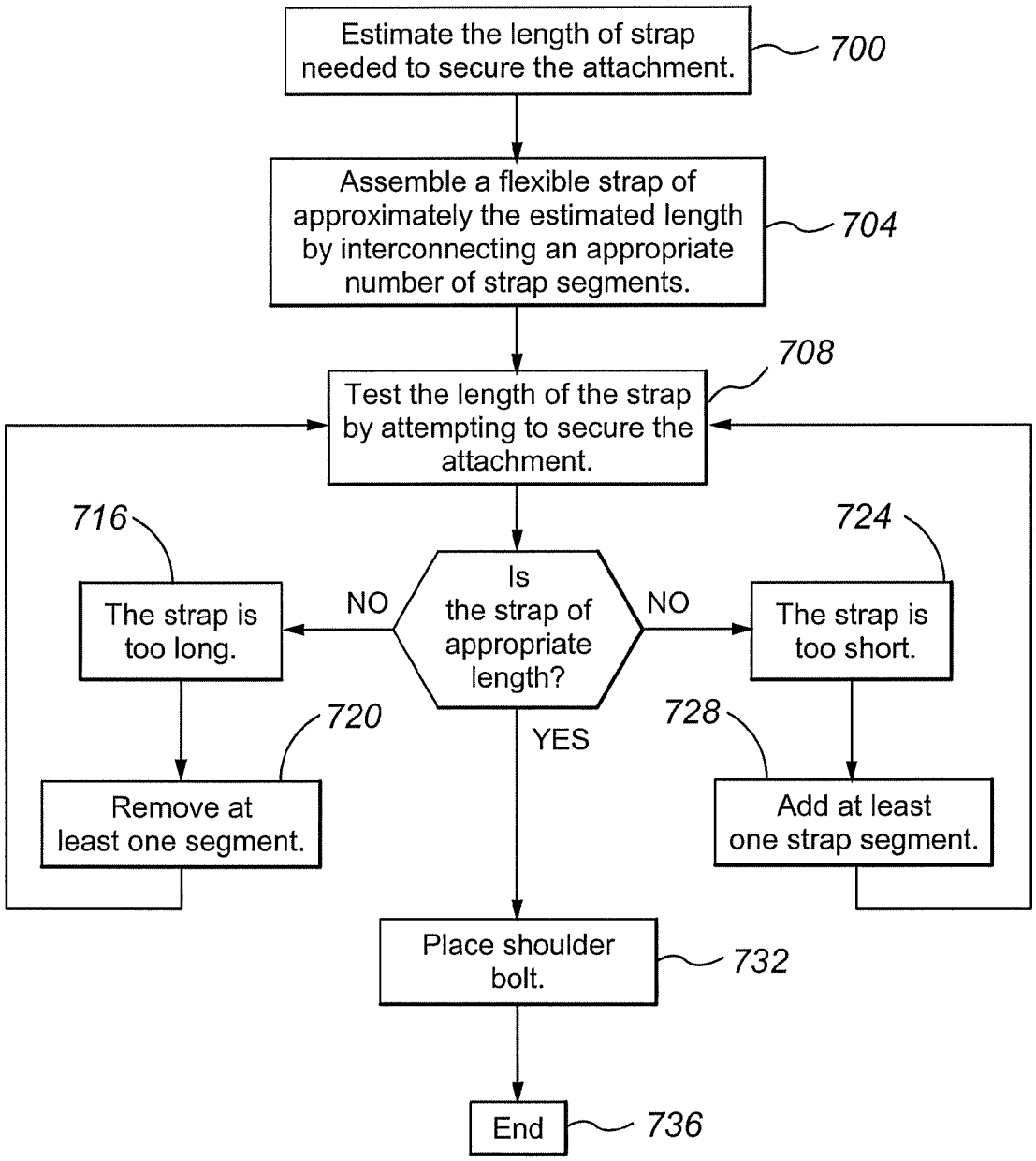
FIG. 7 is flow chart depicting aspects of an installation method in accordance with embodiments of the present invention.

FIG. 7 contains a flowchart illustrating the steps in a method of installing an apparatus for restraining an attachment to a recreational vehicle in accordance with embodiments of the present invention. At step 700, an estimation is made for the length of strap 112 needed to secure the recreational vehicle attachment 104. At step 704, a flexible strap 112 of approximately the estimated length is assembled form a plurality of strap segments 228. At step 708, the length is tested by attempting to secure the attachment 104. At decision diamond 712 it is determined whether or not the strap 112 is of an appropriate length. If it is determined that the length is too long (step 716), an appropriate number of strap segments are removed (step 720) and the length is again tested (step 708). If it is determined that the length is too short (step 724), an appropriate number of strap segments are added (step 728) and the length is again tested (step 708). If, at decision diamond 712, it is determined that the strap is of appropriate length then a shoulder bolt 612 placement may be chosen (step 732) that provides the most secure fit for the strap 112 around the recreational vehicle attachment 104. At this point the installation of the apparatus 100 is complete (step 736).

Figure 8:
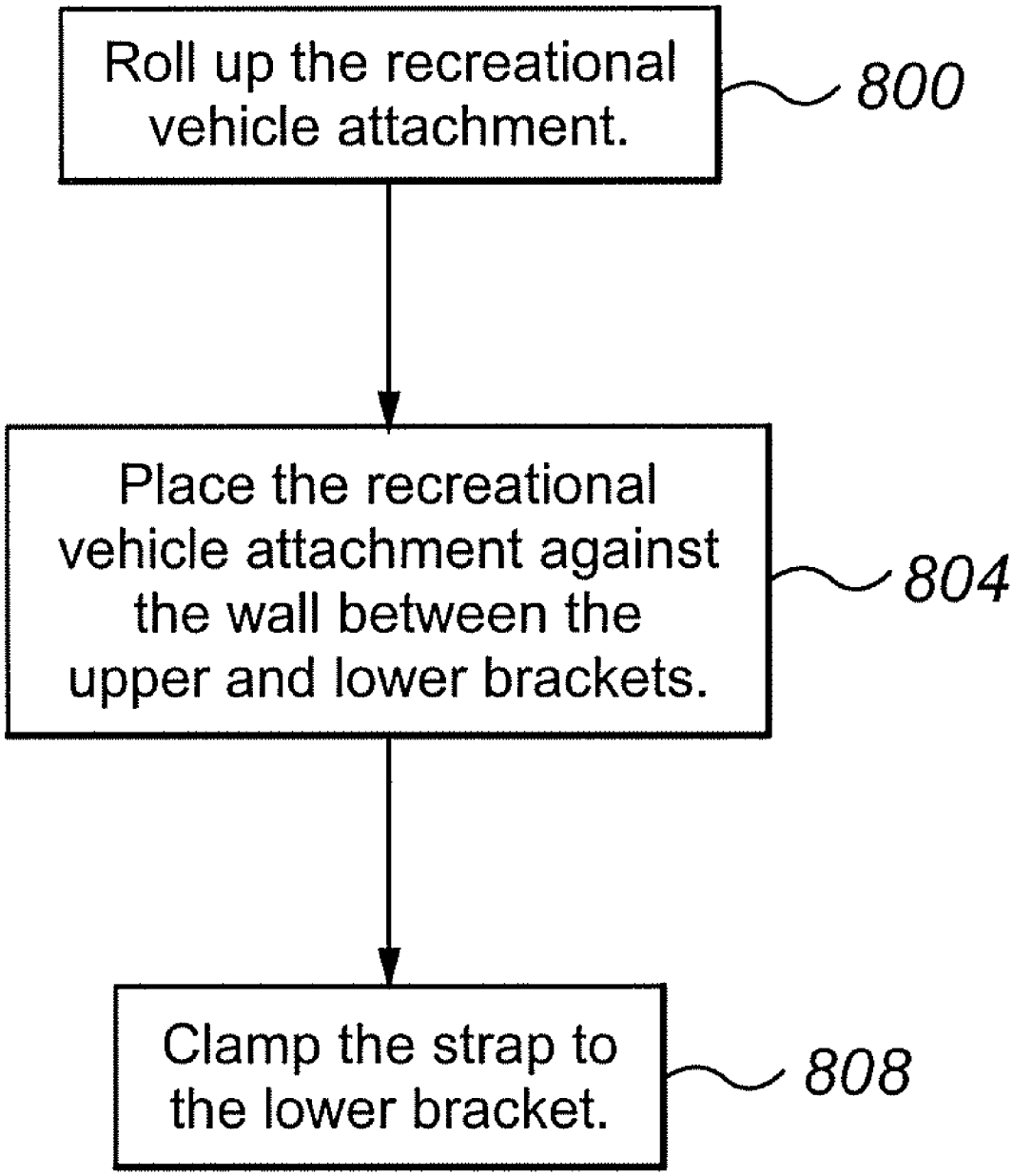
FIG. 8 is a flow chart depicting aspects of a method of restraining a recreational vehicle attachment in accordance with embodiments of the present invention.

FIG. 8 contains a flowchart illustrating the steps in a method of using an apparatus for restraining an attachment to a recreational vehicle in accordance with embodiments of the present invention. First, at step 800, the attachment is rolled-up or otherwise contracted. Then, at step 804, the recreational vehicle attachment is placed against the wall of the recreational vehicle 108 between the upper 116 and the lower 120 mounting portions. Finally, at step 808, the strap 112 is clamped to the lower mounting portion 120.

The present invention, in various embodiments, includes components, methods, processes, systems and/or apparatus substantially as depicted and described herein, including various embodiments, sub combinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description, for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An apparatus for restraining an attachment to a vehicle having a wall, comprising:

at least one flexible member, comprising a plurality of interconnected segments, wherein each segment comprises a male portion having a somewhat rounded end, a longitudinal passageway, and a slot, and a female portion having a somewhat rounded inner surface, a first and a second hole, and a support member disposed at least partially between the first and second holes;

an upper mounting member connected to a first end of the flexible member and being rigidly connectable to the wall of the recreational vehicle; and a lower attachment member connected to a second end of the flexible member and being detachably connectable to a lower mounting member, the lower mounting member being rigidly connectable to the wall of the recreational vehicle;

whereby at least a portion of the attachment may be placed against the wall and secured to the vehicle between the upper mounting member and the lower mounting member.

2. The apparatus as claimed in claim 1, wherein a connection between the plurality of interconnected segments comprises:

a mating between the male portion of a first adjacent segment and the female portion of a second adjacent segment.

3. The apparatus of claim 2, wherein the male portion of the first adjacent segment is fitted between the holes of the female portion of the second adjacent segment, wherein the somewhat rounded end of the first adjacent segment is fitted against the somewhat rounded inner surface of the second adjacent segment, and wherein the support member of the second adjacent segment is received in the slot of the first adjacent segment.

4. The apparatus of claim 3, wherein a screw is placed through the passageway of the first adjacent segment and through the first and second holes and the screw support member of the second adjacent segment, whereby the connection provides a limited amount of rotational freedom between the adjacent segments.

5. The apparatus as claimed in claim 1, wherein the upper mounting member comprises:

a female portion comprising a somewhat rounded inner surface, a first and second screw hole, and a screw support member disposed between the first and second screw holes.

6. The apparatus as claimed in claim 5, wherein the connection of the upper mounting member is provided by an interconnection between the first end of the flexible member and the female potion of the upper mounting bracket.

7. The apparatus as claimed in claim 6, further comprising:

a radii plate and a gasket interposed between the upper mounting member and the wall of the vehicle.

8. The apparatus as claimed in claim 1, wherein the lower mounting member comprises:

a shoulder bolt mounting apparatus comprising a plurality of bolt hole pairs and a shoulder bolt mounted in one of the bolt hole pairs.

9. The apparatus as claimed in claim 1, further comprising:

a gasket interposed between the lower mounting member and the wall of the recreational vehicle.

10. The apparatus as claimed in claim 1, wherein the vehicle attachment comprises an awning.

11. A method of installing an apparatus for restraining a vehicle attachment, comprising the steps of:

rigidly connecting an upper mounting member to the wall of the vehicle;

rigidly connecting a lower mounting member to the wall of the vehicle;

assembling a flexible strap from a plurality of strap segments, wherein each strap segment comprises a male portion having a somewhat rounded end, a longitudinal passageway, and a slot, and a female portion having a somewhat rounded inner surface, a first and a second hole, and a support member disposed at least partially between the first and second holes;

flexibly connecting a first end of the flexible strap to the upper mounting member; and flexibly connecting a second end of the flexible strap to the lower mounting member.

12. The method of claim 11, wherein the lower mounting member includes a lower attachment member.

13. The method of claim 11, wherein the step of assembling the flexible strap comprises adding at least one segment to the strap.

14. The method of claim 11, wherein the step of assembling the flexible strap comprises removing at least one segment from the strap.

15. The method as claimed in claim 11, wherein the vehicle attachment comprises an awning.

16. An apparatus for restraining an attachment to a vehicle having a wall, comprising:

means for interconnecting a plurality of segments to form a flexible strap, wherein each segment comprises a male portion having a somewhat rounded end, a longitudinal passageway, and a slot, and a female portion having a somewhat rounded inner surface, a first and a second hole, and a support member disposed at least partially between the first and second holes;

means for rigidly attaching a first end of the strap to the wall; and means for detachably attaching a second end of the strap to the wall;

whereby the vehicle attachment is capable of being substantially secured between the means for rigidly attaching and the means for detachably attaching by use of the flexible strap.

17. The apparatus as claimed in claim 16, wherein the vehicle attachment comprises an awning.

18. The apparatus as claimed in claim 16, wherein segments may be added to or removed from the strap.

19. The apparatus as claimed in claim 16, wherein one end of the flexible strap may be released from the wall by use of a pole.

* * * * *